US005794292A

United States Patent [19]

Ricci, Jr.

[11] Patent Number: 5,794,292

[45] Date of Patent: Aug. 18, 1998

[54] PORTABLE GANGWAY WITH LEVELING STAIRS

[76] Inventor: Patrick J. Ricci, Jr., 2604 NW. 2nd Ave., Boca Raton, Fla. 33431

[21] Appl. No.: 753,100

[22] Filed: Nov. 20, 1996

[51] Int. Cl.[6] ..... E01D 15/24; B63B 27/14

[52] U.S. Cl. ..... 14/69.5; 182/1

[58] Field of Search ..... 441/125, 126, 441/80, 3, 81; 114/258, 44, 249, 362; 405/205; 182/1, 97, 96; 52/182, 184, 186, 190; 74/109, 98; 14/69.5

[56] References Cited

U.S. PATENT DOCUMENTS

| | | | |
|---|---|---|---|
| Re. 32,023 | 11/1985 | Harr et al. | 441/125 X |
| 1,215,827 | 2/1917 | Lord | 182/1 |
| 2,824,582 | 2/1958 | Reitherman | 74/109 X |
| 4,004,384 | 1/1977 | Hood | 52/188 |
| 4,506,825 | 3/1985 | Grant | 74/109 X |
| 5,454,196 | 10/1995 | Gaines et al. | 14/69.5 X |
| 5,487,349 | 1/1996 | Andreassen | 114/219 |
| 5,553,421 | 9/1996 | Stratford | 52/188 X |

*Primary Examiner*—David J. Bagnell
*Assistant Examiner*—Sunil Singh
*Attorney, Agent, or Firm*—Robert M. Downey, P.A.

[57] ABSTRACT

A gangway to accommodate passage from one floor, platform level, deck surface, or the like to another includes a rigid support structure defining a main frame assembly having a pair of longitudinal frame members extending in spaced, parallel relation to one another substantially along a length of the main frame assembly between opposite ends. A series of step members, each including a substantially flat top step surface, are supported transversely between the longitudinal frame members in close relation to one another; each of the step members being rotatable relative to the main frame assembly about a transverse axle. A drive gear assembly within the main frame assembly is structured for synchronized rotation of the step members relative to the frame assembly so that the top step surfaces of each of the step members remain level, at a preferred horizontal orientation, upon a change in inclination of the longitudinal frame members as one of the ends of the frame assembly moves through an arc about a main pivot axis at the opposite end. Hand rails are removably attachable along the outboard sides of the longitudinal frame members.

5 Claims, 5 Drawing Sheets

PORTABLE GANGWAY WITH LEVELING STAIRS

BACKGROUND OF THE INVENTION

1. Field of the Invention

The present invention relates to gangways, stairways, and ladders. More specifically, the present invention relates to a portable gangway having a series of steps and means for adjusting the orientation of the steps so that a top step surface of each step remains level as the angle of inclination of the gangway is varied.

2. Description of the Related Art

The need to walk or travel from one floor, platform level, or deck to another is encountered by most people throughout the course of their daily excursions. When two or more levels are fixed as a permanent structure and do not move relative to one another, a fixed structure such as a stairway, escalator and/or elevator are often employed as a means to facilitate convenient and safe passage between the two or more levels. In other instances, the various levels may be mobile or transitory, and thus a fixed structure is not practical. Still, in other situations, two platform levels or deck surfaces may constantly move relative to one another. A boat rising and lowering with the tide relative to a dock is an example of this type of a situation. In these instances, wherein a fixed structure such as a stairway is not practical, ladders, planks, ramps, and remote gangways are typically used so that persons can walk or climb from one deck surface level to another.

In the past, ladders, gangways, and ramps have proven to be awkward, especially when at least one of the deck surfaces is moving. Many times, the angle of inclination of a ramp or ladder make it dangerous, if not impossible, to traverse between two deck surfaces or platforms. For instance, when the angle of inclination of a ladder becomes more horizontal, the top step surfaces become awkwardly angled, requiring a person to step on the edge of the step, rather than the top surface. On the other hand, a ramp becomes too difficult to travel when it reaches angles of inclination of 40° of greater, becoming more vertically inclined.

In an effort to accommodate for varying heights and distances between two platform or deck surfaces, various adjusting stairways, gangways, and ladders have been proposed in the related art. Many of these proposed structures are cumbersome, heavy and not easily transported for use at various locations. Further, some of these proposed adjusting and/or portable ladders have been known to collapse while people are traversing them. The proposed structures in the prior art all fail to provide a convenient, safe, portable and lightweight yet sturdy gangway having a series of steps which continually adjust so that a top flat step surface of each of the steps remains level as the angle of inclination of the gangway changes.

OBJECTS AND ADVANTAGES OF THE PRESENT INVENTION

It is a primary object of the present invention to provide a portable, lightweight gangway which is structured to provide a safer, more versatile means to travel between two platform surfaces of varying heights, angles, and/or distances that otherwise make passage difficult or dangerous.

It is another object of the present invention to provide a portable, lightweight and sturdy gangway having a plurality of steps and means for automatically adjusting the steps so that a top step surface of each of the steps remains level at a preferred horizontal orientation as the angle of inclination of the gangway varies.

It is still a further object of the present invention to provide a gangway having a series of adjusting steps, wherein a top step surface of each of the steps remains level as the angle of inclination of the gangway is moved through a range of 180°.

It is still a further object of the present invention to provide a gangway which includes buoyancy means so that the gangway will float in the event it falls into the water.

It is still a further object of the present invention to provide a gangway which includes means to accommodate passage of a wheelchair therealong throughout a range of angles of inclination.

It is still a further object of the present invention to provide a portable, lightweight gangway having the advantages as set forth above and which is useful for numerous applications including: shore to vessel passage; as a drop ladder for attics; a mobile ladder mounted to a truck for drive up boarding (as in airport applications); as a fire escape; fire trucks and boom trucks; as a temporary construction walkway ramp; as well as numerous other applications.

With the foregoing objects and advantages in mind, the present invention is directed to a gangway to accommodate passage from one floor, platform level, deck surface, or the like to another surface. The gangway includes a rigid support structure defining a main frame assembly having a pair of longitudinal frame members extending in spaced parallel relation to one another substantially along a length of the main frame assembly between opposite ends. A series of step members, each including a substantially flat top step surface, are supported transversely between the longitudinal frame members in close, spaced relation to one another. Each of the step members are rotatable relative to the main frame assembly about a transverse axle. A drive gear assembly fitted along the longitudinal frame members is structured for synchronized rotation of the step members relative to the frame assembly so that the top step surfaces of each of the step members remain level, at a preferred horizontal orientation, upon a change in inclination of the longitudinal frame members as one of the ends of the frame assembly moves through an arc about a main pivot axis at the opposite end. Hand rails are removably attachable along the outboard sides of the longitudinal frame members.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENTS

Figures 1, 7, 8A, 8B:
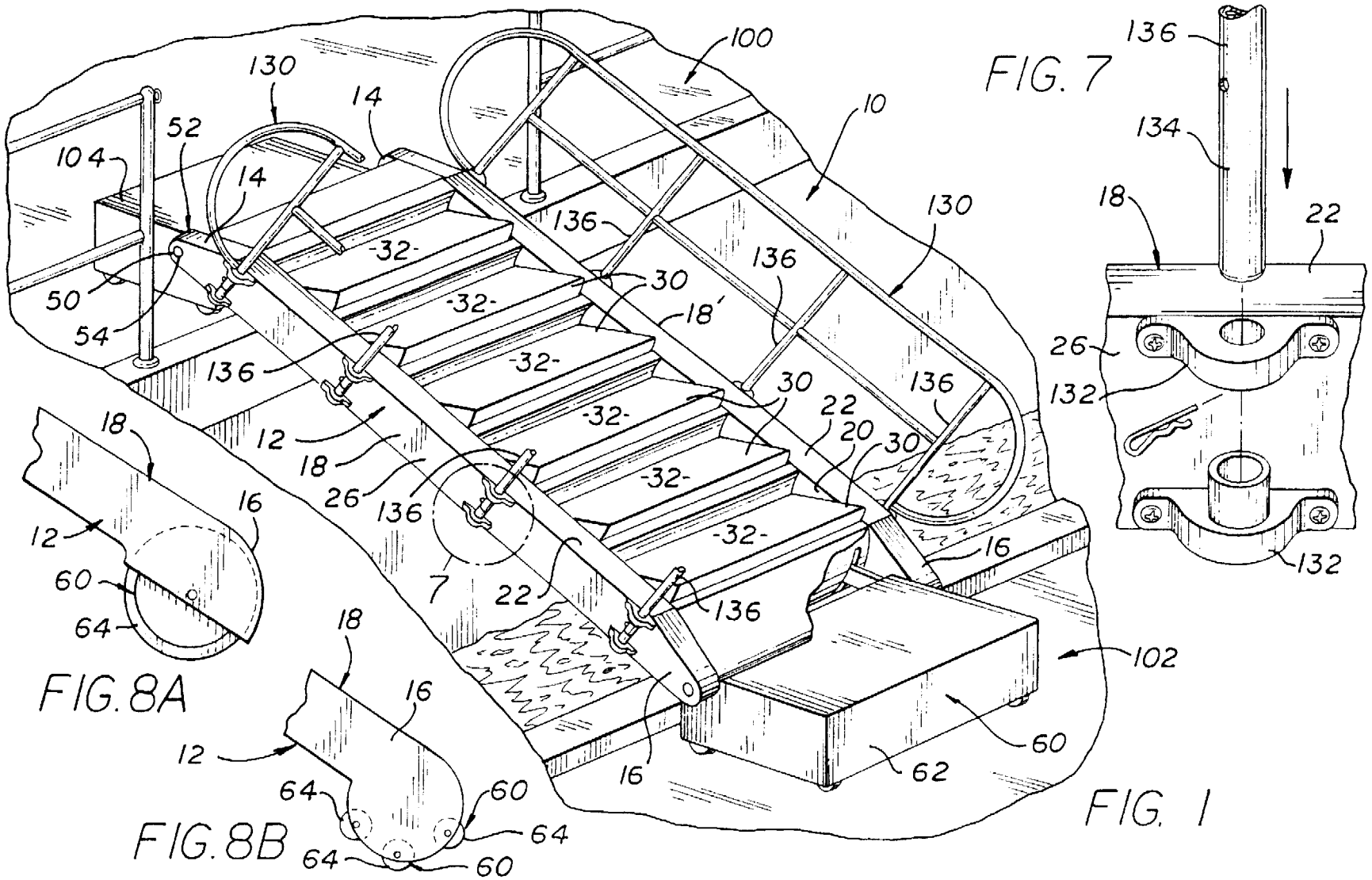
FIG. 1 is a perspective view of a first preferred embodiment of the gangway of the present invention.
FIG. 7 is an isolated perspective view illustrating attachment of a hand rail structure to an outboard side of the longitudinal frame members.
FIG. 8A is an isolated side elevation of an alternative embodiment of a free, moving end zone of the gangway.
FIG. 8B is an isolated side elevation of yet another embodiment of the free moving end zone of the gangway.

Referring to the several views of the drawings, the gangway of the present invention is shown and is generally indicated as 10. The gangway 10 is structured to accommodate passage from one landing structure 100 to another landing structure 102, such as from one platform level to another platform level. FIG. 1 illustrates one particular application wherein the gangway 10 spans between a floating vessel and a dock or pier. And, while this is a particularly useful application, the gangway 10 can be used to accommodate passage to any type of platform level or landing structure including, but not limited to, passage between a fixed pier and a floating dock, as a drop ladder for attics, a mobile ladder mounting to a truck for drive up boarding (as in airport applications), as a fire escape or as a temporary construction walkway ramp.

The gangway 10 includes a rigid support structure which provides a main frame assembly 12 having opposite ends, including a first end 14 and a second end 16. The main frame assembly 12 is comprised primarily of a pair of longitudinal frame members 18, 18' which extend a length of the main frame assembly 12, between the opposite ends 14, 16, in spaced, parallel relation to one another. Each of the longitudinal frame members 18, 18' includes a main gear mount wall 20 and top and bottom plates 22, 24 perpendicular to the main wall 20. An outboard cover plate 26 may further be provided to enclose an interior gear chamber 28 between the top and bottom plates 22, 24 on the outboard sides of the main walls 20 of each longitudinal frame member 18, 18'.

Figures 2A, 2B, 6:
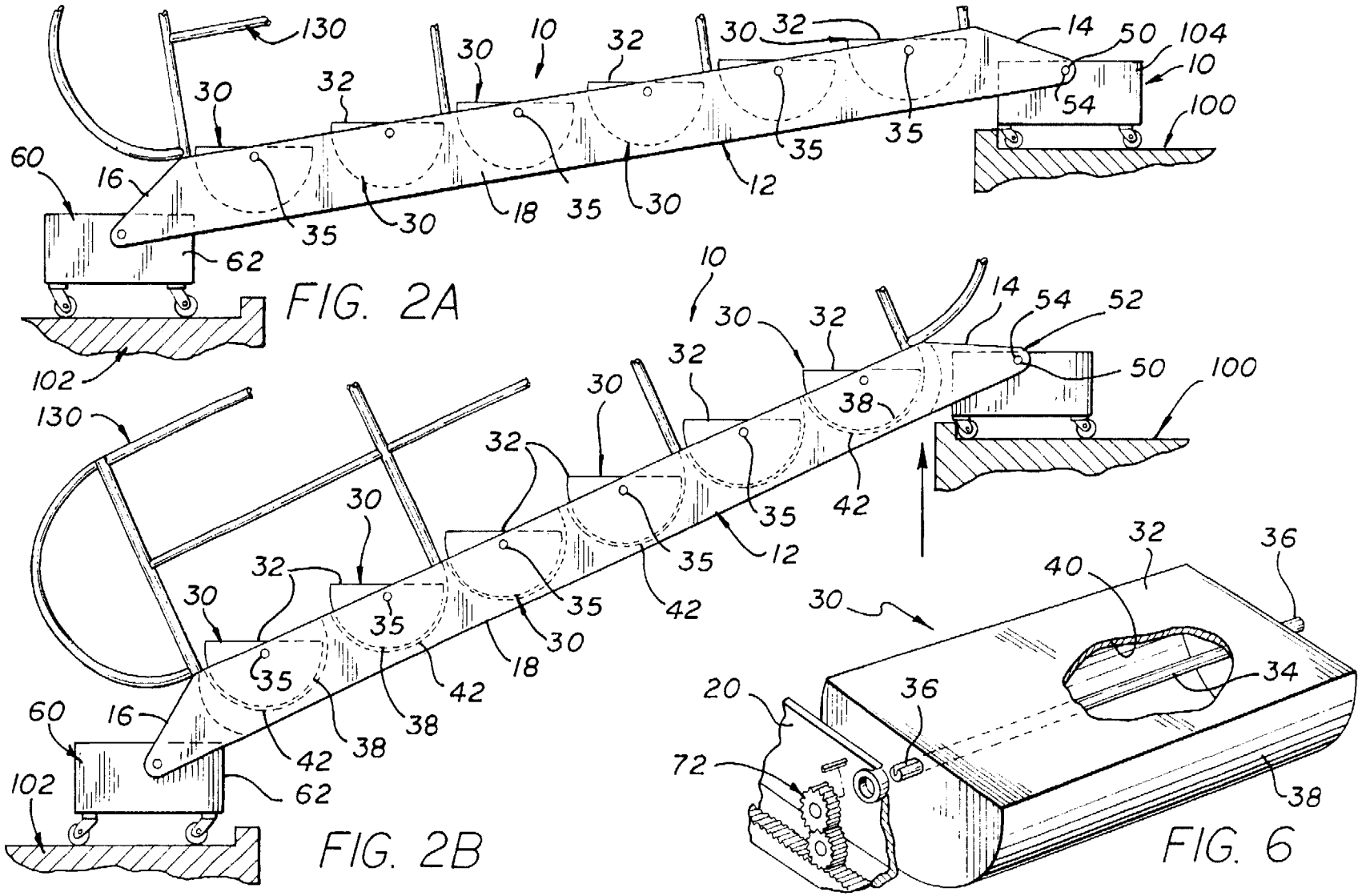
FIGS. 2A–2B are diagrammatic illustrations showing the gangway at different angles of inclination, as the top surfaces remain level.
FIG. 6 is an isolated perspective view of a step member and associated gear elements for rotating the step member.
Figure 3:
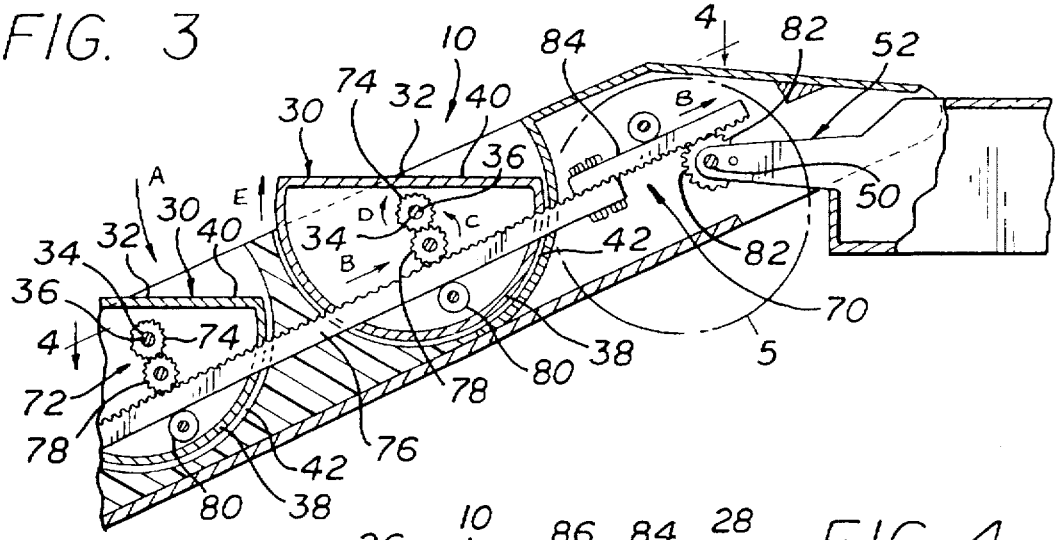
FIG. 3 is an isolated sectional view of a pivot end of the frame assembly of the gangway, illustrating a drive gear assembly for synchronized rotation of each of the step members.

A plurality of step members 30, each including a flat top step surface 32, are supported transversely between the inboard faces of the main walls 20 of the longitudinal frame members. Each of the step members 30 are rotatable relative to the main frame assembly 12 about respective central transverse axles 34 spanning between the main walls and defining a rotational axis 35 for each step member. The transverse axles 34 include opposite end zones 36 fitted through the main walls and within the gear chambers 28 of each longitudinal frame member 18, 18'. In a preferred embodiment, each of the step members 30 includes a semi-cylindrical bottom wall structure 38 and a flat top plate 40 which is positioned above the rotational axis 35 of the step member so that the flat step surface of each step is flush with the upper surface of the top plates 22 when the gangway 10 is horizontal. The rotational axis 35 of each step member 30 defines the center of the radius of the bottom semi-cylindrical wall 38 so that as each step member rotates, the bottom wall travels through a circular path. This enables each step member to rotate within its own cavity 42, as best seen in FIGS. 2A, 2B, and 3, eliminating open gaps between the steps. As described more fully hereinafter, the step cavities 42 may be provided by an insert structure which fits between the longitudinal frame members from an underside of the frame assembly 12, attaching to the bottom plates 24.

In a preferred embodiment, one of the opposite ends 14, 16 of the frame structure 12 is mounted to the landing structure 100, or a fixed step table 104 on the landing structure, while the opposite end is free to move on another landing structure 102, as seen in FIGS. 1, 2A and 2B. Means for mounting one of the ends of the frame assembly, for instance the first end 14, to the landing structure is pivotally fitted to the frame assembly 12, and specifically the longitudinal frame members, to define a main pivot axis 50. In one embodiment, the mounting means 52 is comprised of a pivot axle 54 rotatably fitted at opposite ends to the longitudinal frame members 18, 18' and fixed to either a step table 104 or like structure, or directly to the landing structure 100.

Figure 9:
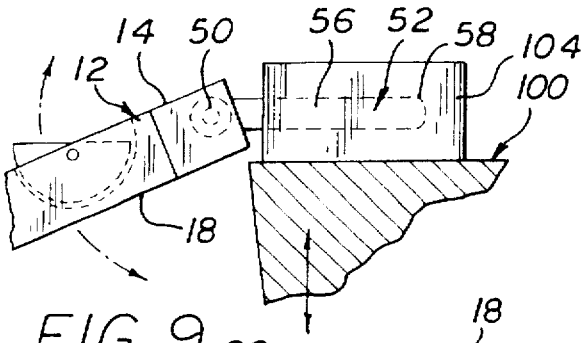
FIG. 9 is an isolated side elevation illustrating fixed attachment of a pivot arm at the pivot end of the gangway to a fixed step table.
Figure 10:
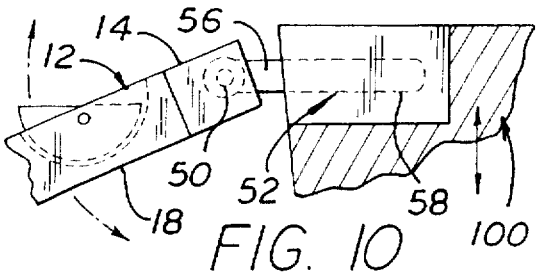
FIG. 10 is an isolated side elevation illustrating fixed attachment of a pivot arm at the pivot end of the gangway to the side wall of a structure, such as the hull of a vessel.

In another embodiment, the mounting means 52 is comprised of a pair of pivot arms 56 which extend from one of the ends of the frame assembly, for instance the first end 14, as illustrated in FIGS. 9 and 10. One end of each of the pivot arms 56 is fixed at the main pivot axis 50 of the gangway 10 while an opposite free end zone 58, spaced from the end 14 of the frame assembly 12, is structured for fitted, removable receipt within sockets or channels formed in either a step table 104 or directly through the side wall of the landing structure 100 (e.g., the side hull of a vessel just below the boarding deck, as seen in FIG. 10).

The opposite end 16 of the frame assembly 12 may be provided with roller means 60 to facilitate horizontal movement across the landing surface as the angle of inclination of the gangway changes, due to vertical movement of the second end relative to the first end of the frame assembly. FIGS. 1, 2A and 2B illustrate one embodiment wherein the second end 16 of the frame assembly 12 is pivotally fitted to a rolling step table 62 which moves on the landing surface as the gangway's angle of inclination changes, as seen in FIGS. 2A and 2B.

In another embodiment, the second end 16 of the frame assembly may be provided with rollers 64, as seen in FIGS. 8A and 8B, for accommodating movement along the landing surface.

Maintaining the flat top step surfaces 32 of each of the step members 30 level is a primary function of the gangway 10. To achieve this, a primary drive means 70 is provided for synchronized rotating of the step members 30 relative to the frame assembly 12, as the second end 16 of the frame assembly moves vertically relative to the first end 14, thus changing the angle of inclination. When the second end 16 of the frame assembly moves vertically, relative to the first end 14, it actually travels through an arc about the main pivot axis 50 at the first end 14.

Figure 4:
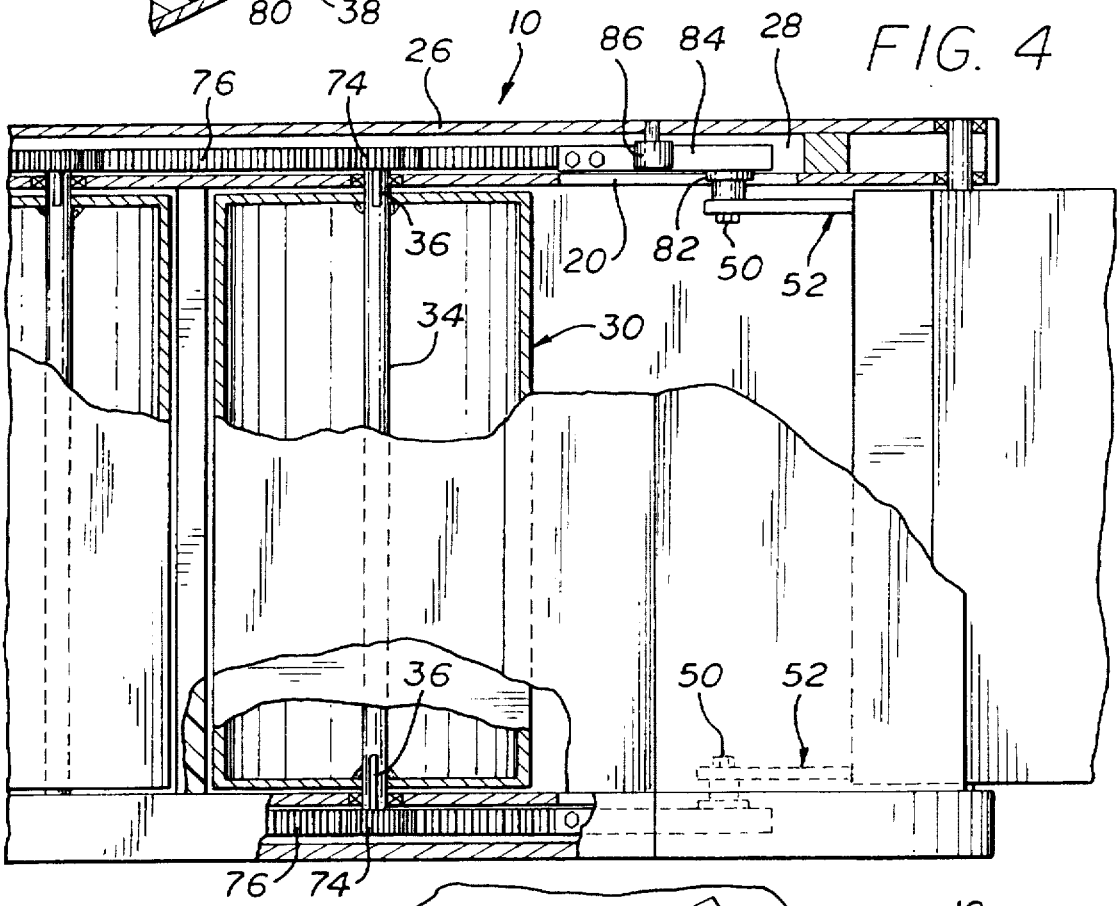
FIG. 4 is an isolated top plan view, in partial cutaway, illustrating placement of the step members between longitudinal frame members.
Figure 5:
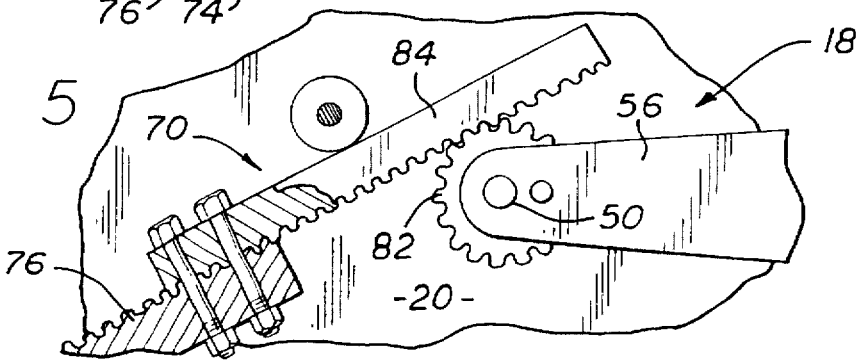
FIG. 5 is an isolated view taken from the area indicated as 5 in FIG. 3.

The drive means 70 includes a drive gear assembly 72 operatively communicating between the main pivot axis 50 and each of the transverse axles 34 of the respective step members 30. The drive gear assembly 72 rotates the transverse axles 34 and step members 30 relative to the main frame assembly 12, as the second end 16 of the main frame assembly moves through an arc about the main pivot axis 50 at the opposite end 14. The drive gear assembly 72 includes a plurality of step gears 74 fitted to the respective opposite end zones 36 of the transverse axles 34 within the gear chamber 28, close to the outboard face of the main wall 20 of the longitudinal frame members 18, 18', as seen in FIGS. 4 and 6. An elongate rack gear 76 extends substantially along the length of each of the longitudinal frame members, within the respective gear chambers. The elongate rack gears 76, in each chamber 28, are disposed in driving engagement with the step gears 74 on the transverse axles 34. In a preferred embodiment, intermediate gears 78 are provided between the rack gear 76 and the step gears 74 to provide a preferred gear ratio so that as the step members 30 rotate with the change of inclination of the frame assembly 12, the top step surfaces 32 remain level. The intermediate gears 78 also provide the desired direction of rotation of the step members as the rack gear 76 moves longitudinally towards either the first end 14 or opposite second end 16 of the frame assembly. For instance, as the elongate rack gears 76 move in the direction indicated by the arrow B, in FIG. 3, the step members 30 rotate in the direction indicated by the arrow E, thus maintaining the top flat step surface 32 level. Rollers 80 rotatably fitted to the outboard face of the main walls 20 in each of the gear chambers 28 engage an underside of the elongate rack gears 76, below the step gears 74 and intermediate gears 78. The rollers 80 serve to guide the longitudinal movement of the rack gears 76 while maintaining the teeth of the rack gears 76 in driving engagement with the intermediate gear teeth.

Pivot gears 82 are fixed to the mounting means 52, such as on the ends of the pivot arms 56, at the main pivot axis 50. The pivot gears 82 engage an inverted rack gear segment 84 fixed to the ends of the rack gears 76. Rollers 86 near the pivot end 14, within the gear chamber, engage the inverted rack gear segment 84 to guide the rack gear segment in driving engagement with the pivot gears 82.

Referring to FIG. 3, as the gangway 10 moves downwardly in the direction indicated by the arrow A, the pivot gears 82 engage the rack gear segments 84 pulling the rack gear segments and rack gears 76 in the direction of the arrows B. Movement of the rack gear drivingly rotates the intermediate gears 78 in the direction of the arrows C, which in turn rotates the step gears 74 in the direction of the arrow D. This results in relative rotation of the step members 30 in the direction of the arrow E, so that the top flat step surface 32 remains horizontal and level with the landing surface throughout a range of movement of the second end of the frame assembly of at least 1800 about the main pivot axis.

Figure 11:
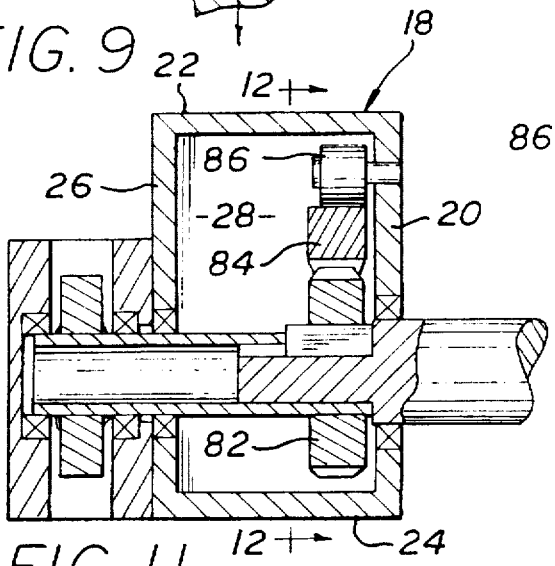
FIG. 11 is a front elevation, in section, of a gear box and pivot arm assembly, illustrating the various component elements thereof.
Figure 12:
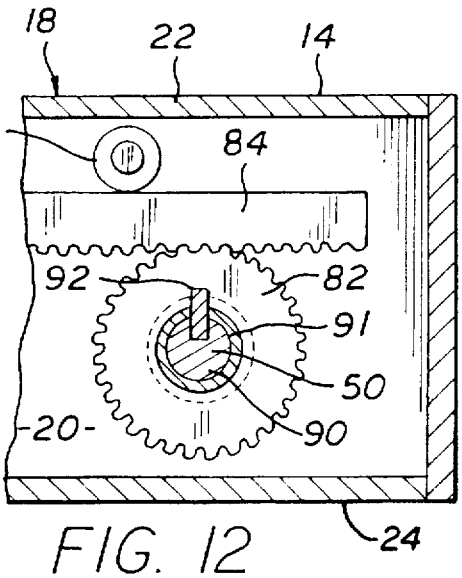
FIG. 12 is an isolated side elevation illustrating intermeshing of a pivot spur gear with a rack gear extension member, in accordance with a preferred embodiment of the present invention.
Figure 13:
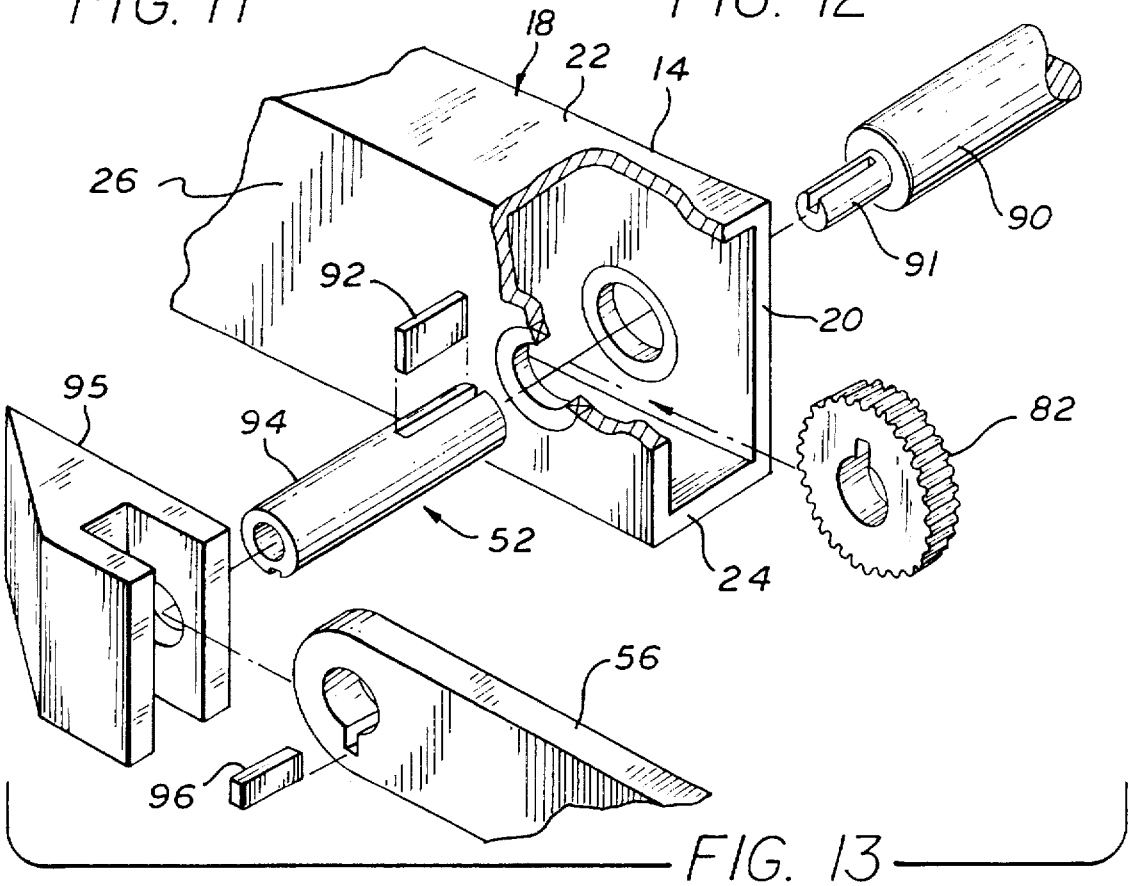
FIG. 13 is an isolated exploded view illustrating a pivot arm and axle assembly in accordance with a preferred embodiment of the present invention.

In one preferred embodiment, as seen in FIGS. 11–13, the mounting means 52 includes pivot arms 56 fitted to each of the longitudinal frame members 18, 18', at the main pivot axis 50. A transverse pivot axle 90 extends along the main pivot axis 50 between the longitudinal frame members and includes a reduced diameter at each of the opposite ends 91 for receipt within the gear chamber 28. The pivot gears 82 are fitted to the opposite ends 91 of the transverse pivot axle 90. Both the reduced diameter ends and the pivot gears are notched to receive a key 92 to lock the pivot gears 82 on the transverse pivot axle 90. A load bearing axle extension 94 is also keyed to the reduced diameter ends 91 of the transverse axle and extends within a mounting support brace 95. The support braces 95 on each side are slotted to receive the end of the respective pivot arms 56 which are also provided with a notch to receive a key element 96, thereby locking the pivot arms to the respective load bearing extension axles 94. In operation, the pivot arms 56, extension axles 94, pivot gears 82, and transverse axle 90 remain fixed relative to one another. The mounting braces 95 are attached to the outer cover members 26 of each of the longitudinal frame remembers. As the angle of inclination of the gangway changes, the longitudinal frame members 18, 18' and mounting brace 95 rotate about the extension axles, pivot gears, and transverse axle.

Figure 14:
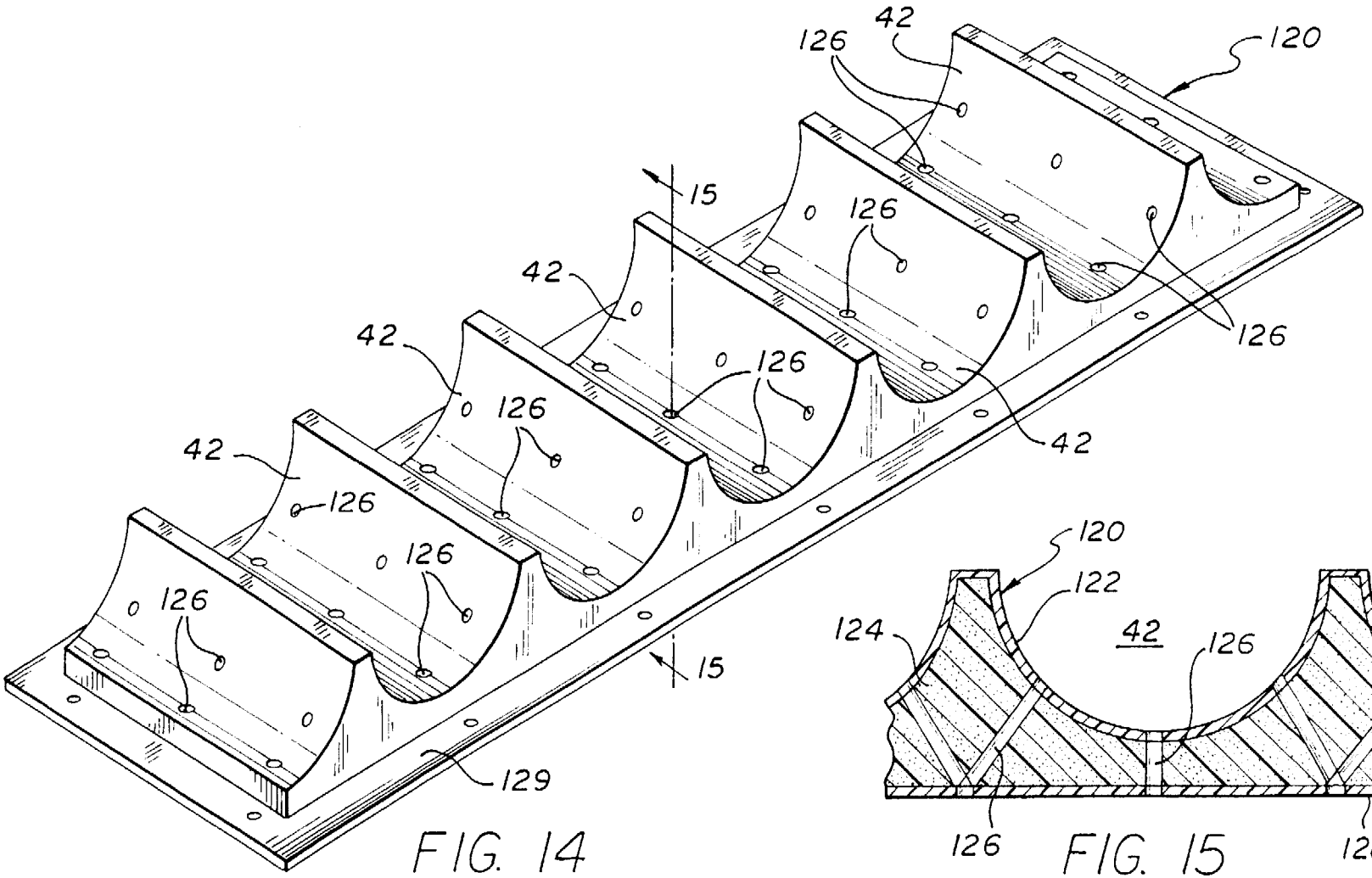
FIG. 14 is a top perspective view of a foam filled insert attachable to a bottom side of the gangway to provide flotation means as well as individual step rotation chambers for each of the respective step members.
Figure 15:
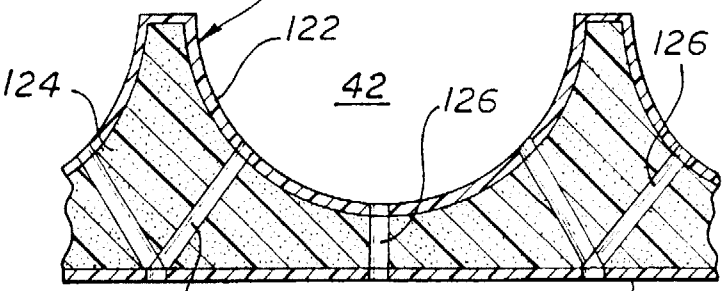
FIG. 15 is an isolated sectional view taken along the plane of the line 15—15 of FIG. 14.

Referring to FIGS. 14 and 15, a buoyant insert 120 is shown, providing the step cavities 42, as described above. In a preferred embodiment, the insert 120 is formed of a molded plastic shell 122 or other suitable material. A hollow interior of the shell is filled with foam 124 to provide buoyancy. Thus, with the insert 120 fitted to the frame assembly 12, the gangway will float should it fall in the water. Drain channels 126 are provided through the insert, from the step cavities 42 to the bottom side 128 to drain water which collects below the step members 30 within the step cavities 42. A flange 129 about the periphery of the insert facilitates direct mounting to the bottom plates 24 of the longitudinal frame members 18, 18'.

Referring to FIGS. 1 and 7, handrails 130 may be provided along the length of the longitudinal frame members 18, 18'. In a preferred embodiment, mounting brackets 132 fitted to the outboard facing covers 26 of the longitudinal frame members receive lower end zones 134 of posts 136 of the handrails 130. A cotter pin or other conventional hardware may be used to fix the lower end zones 134 of the posts 136 within the brackets 132, as seen in FIG. 7. It is preferred that the handrails 130 be mounted outboard of the top plates 22 of the longitudinal frame members, so that they do not interfere with travel of the wheels of a wheelchair along the top plates.

While the instant invention has been shown and described in what are considered to be preferred and practical embodiments thereof, it is recognized that departures may be made within the spirit and scope of the present invention which, therefore, should not be limited except as defined within the following claims and within the Doctrine of Equivalents.

Now that the invention has been described,

What is claimed is:

1. A gangway to accommodate passage to at least one landing structure having a deck surface;

said gangway comprising:

a rigid support structure defining a main frame assembly having opposite first and second ends, said main frame assembly including a pair of longitudinal frame members extending a length of said main frame assembly between said opposite ends, said longitudinal frame members being disposed in spaced, parallel relation to one another, a plurality of step members each including a substantially flat top step surface, said step members being supported transversely between said longitudinal frame members and each of said step members being rotatable relative to said main frame assembly about a transverse axle having opposite end zones, mounting means at said first end of said frame assembly for mounting said gangway to the landing structure and being pivotally fitted to said main frame assembly to define a main pivot axis, primary drive means for synchronized rotating of said plurality of step members relative to said main frame assembly so that said flat top step surfaces of said step members remain level in parallel relation to one another upon a change in an angle of inclination of said main frame assembly as said second end of said main frame assembly moves through an arc about said main pivot axis, said longitudinal frame members each including a main inboard wall, and top and bottom plates disposed in spaced relation to one another and perpendicular to said main inboard wall to define a gear chamber along a length of each of said longitudinal frame members between said top and bottom plates, said main inboard walls of said respective longitudinal frame members being disposed in spaced, parallel relation relative to one another to accommodate said step members therebetween, said transverse axles of said step members being rotatably fitted through said main inboard walls of said longitudinal frame members so that said opposite end zones of said axles are positioned and disposed within said gear chambers, said primary drive means including a drive gear assembly operatively communicating between said main pivot axis and each of said transverse axles of said respective step members, said drive gear assembly rotating said transverse axles and said step members, respectively, relative to said main frame assembly as said second end of said main frame assembly moves relative to said main pivot axis, said drive gear assembly including:

a plurality of step gears each fitted to a respective one of said opposite end zones of said transverse axles within said gear chamber and being fixed thereto so as to be rotatable with said transverse axles;

an elongate rack gear in each of said gear chambers of said longitudinal frame members, said elongate rack gear in each gear chamber being disposed in driving engagement with said step gears on said transverse axles and being movable longitudinally in one direction towards said first end of said main frame assembly and an opposite direction towards said second end of said main frame assembly so as to rotate said step gears, said transverse axles and said step members in either of two opposite rotational directions;

pivot gears in each of said respective gear chambers, said pivot gears drivingly engaging said elongate rack gears to cause longitudinal movement of said rack gears upon swinging, rotational movement of said main frame assembly about said pivot gears;

a plurality of intermediate gears rotatably engaged between said elongate rack gear and said step gears in each of said gear chambers; and a plurality of rollers rotatably supported within said gear chambers and engaging said longitudinal rack gear in each of said gear chambers to guide longitudinal movement of said rack gear and to maintain said rack gear in driving engagement with said intermediate gears.

2. A gangway as recited in claim 1 wherein said mounting means includes at least one arm member extending from said first end of said frame assembly and including a fixed end at said main pivot axis and an opposite free end zone structured and disposed for mounting attachment at said landing structure.

3. A gangway as recited in claim 1 further including handrail assemblies removably attachable to said main frame assembly along said longitudinal frame members.

4. A gangway as recited in claim 1 further including an insert structure providing a plurality of chambers for each of said step members, said chambers being structured and configured to accommodate rotation of said step members therein.

5. A gangway as recited in claim 4 wherein said insert includes an outer shell and a foam-filled interior to provide buoyancy to said gangway.

* * * * *